United States Patent [19]

Maron et al.

[11] 4,137,363

[45] Jan. 30, 1979

[54] MATRIX MATERIAL FOR PRINTING PLATES AND METHOD OF MANUFACTURE THEREOF

[75] Inventors: Clarence G. Maron, Vernon; Donald W. Sundstrom, Storrs, both of Conn.

[73] Assignee: Rogers Corporation, Rogers, Conn.

[21] Appl. No.: 784,733

[22] Filed: Apr. 5, 1977

Related U.S. Application Data

[63] Continuation of Ser. No. 581,380, May 27, 1975, abandoned.

[51] Int. Cl.[2] ..... B41B 5/02

[52] U.S. Cl. ..... 428/338; 101/12; 101/401.2; 264/119; 264/122; 264/227; 428/323; 428/325; 428/339; 428/908

[58] Field of Search ..... 428/908, 909, 323, 281, 428/283, 306, 308, 325, 338, 339; 264/109, 119, 218, 227, 122; 101/12, 401.2

[56] References Cited

U.S. PATENT DOCUMENTS

| | | | |
|---|---|---|---|
| 3,700,541 | 10/1972 | Shrimpton | 428/908 |
| 3,707,434 | 12/1972 | Stayner | 428/308 |
| 3,887,750 | 6/1976 | Duckett et al. | 428/909 |
| 3,931,441 | 1/1976 | Milewski | 428/283 |

*Primary Examiner*—Stanley S. Silverman

[57] ABSTRACT

A printing plate matrix is presented including mineral and/or organic fibers, thermosetting resin, and glass microbubbles uniformly dispersed throughout the material.

16 Claims, No Drawings

MATRIX MATERIAL FOR PRINTING PLATES AND METHOD OF MANUFACTURE THEREOF

This is a continuation, of application Ser. No. 581,380, filed May 27, 1975 now abandoned.

BACKGROUND OF THE INVENTION

This invention relates to the field of matrix materials for printing plates. More particularly, this invention relates to the field of matrix material used to form a mold which is, in turn, used in the formation of flexographic printing plates, particularly rubber printing plates.

Matrix materials are known for use in forming both relatively shallow (below 0.15 inches) relief printing plates and relatively deep (0.15 to 0.30 inches) relief printing plates. Each of these matrix materials has its own characteristics and problems. A principal problem with the matrix material for deep relief printing plates is in obtaining the desired deep relief in the matrix material, while two of the more principal problems in the formation of a matrix for shallow relief printing plates are in (1) character definition, i.e., producing sharply defined impressions in the matrix material so that correspondingly sharply defined printing areas will be formed on the flexographic printing plate, and (2) ripple, the degree of nonsmoothness of the base areas of the matrix after molding (which become the printing areas on the final flexographic plate).

SUMMARY OF THE INVENTION

The present invention is directed to a printing plate matrix material and a method of manufacture thereof wherein the matrix material includes organic and mineral fibers, thermosetting resin and microbubbles in a uniformly dispersed mixture. The matrix material is intended primarily for the formation of relatively shallow relief flexographic printing plates, the matrix material being capable of relief depressions primarily, but not exclusively, on the order from 0.15 inches and below, depending upon the overall thickness of the matrix material. The presence of the glass microbubbles in the matrix material results in a matrix material which is capable of extremely sharp character definition and improved ripple characteristics when used in forming a matrix for flexographic printing plates. The glass microbubbles are incorporated in the matrix material in a percentage range from approximately 5% to 50% by weight, and preferably from 5% to 25% by weight.

DESCRIPTION OF THE PREFERRED EMBODIMENT

A matrix material formed in accordance with the present invention will preferably range in thickness from approximately 0.05 inches to approximately 0.3 inches, that thickness range being referred to as "thin" herein. The matrix material may be formed on cylinder machinery or other machinery used in paper making, or may be cast or otherwise formed in any desired manner. The charge or "furnish" from which the matrix material is formed is a uniform mixture which includes natural and mineral fibers, phenolic resin, and from 5% to 25% microbubbles. The microbubbles need not necessarily be spherical in shape, but they are preferably glass microspheres ranging in diameter size from 5 microns to 300 microns and having a particle density ranging from approximately 0.14 g/cc to 0.6 g/cc and a bulk density ranging from approximately 3.5 lb/ft.$^3$ to 25 lb/ft.$^3$. The matrix material is formed in sheets of desired thickness from the uniformly mixed furnish, dried and finished, and it is then brought into contact with a master and molded under heat and pressure in the normal manner. It has been determined that matrix material formed with from 5% to 25% by weight of microbubbles has improved character definition (i.e. improved sharpness of character in both the molded matrix plate and the resultant flexographic printing plates) and improved ripple characteristics (i.e. improved smoothness of the base surfaces of the matrix material (after molding) and resultant flexographic printing plates).

The microbubbles may be any known microcellular or microporous material, and they are preferably glass microspheres. The resins, which are phenol formaldehyde resins, are preferably phenolic resins which may be both resole and novolak resins selected to have melting points compatible with the temperature and pressure at which the matrix board is to be molded. The organic fibers used in the matrix board are typically cellulose fibers such as cotton and wood pulp; and the mineral fibers are typically asbestos fibers. The organic fibers constitute from 0% to 65% of the matrix material; the mineral fibers constitute from 0% to 65%; the microbubbles constitute from 5 to 25%; the resin constitute from 20% to 50%; and the remainder is dyes, buffers and fillers, all percentages being weight percentages.

In all of the following examples a uniform mixture, known as a furnish, was prepared from the listed ingredients and formed into sheets of matrix material ranging in thickness from 0.06 inches to 0.29 inches, as follows with all materials listed in pounds:

TABLE I

| Furnish Ingredients | Example 1 | Example 2 | Example 3 | Example 4 | Example 5 |
|---|---|---|---|---|---|
| Wood Pulp Fibers | 200 | 200 | 278 | 200 | 200 |
| Cotton Fibers | 188 | 188 | — | 188 | 188 |
| Asbestos Fibers | 450 | 450 | 390 | 400 | 400 |
| Phenolic Resin | 505 | 505 | 390 | 465 | 465 |
| Lime (pH) Adjustment) | 7 | 7 | 5 | 7 | 7 |
| Black Dye (color agent) | 3 | 3 | — | 3 | 3 |
| Hexamethyl amine (cross-linking agent) | 100 | 100 | 100 | 100 | 100 |
| Glass Microbubbles | 75 | 100 | 85 | 100 | 200 |

The furnish was formed into sheets of matrix material and then calendered both to establish the final desired thickness and to impart a desired finish to the material. It will be understood that at this point the resin has not been thermoset, and hence most of the structural strength of the material is derived from the intertwining of the fibrous materials.

The materials of Examples 1–5 had the following physical characteristics:

TABLE II

| | Thickness | Average[1] Density | Density[2] Before | Density[3] After |
|---|---|---|---|---|
| Example 1 | 0.118" | .733 g/cc | .782 g/cc | .768 g/cc |
| Example 2 | 0.175" | .716 | .768 | .778 |
| Example 3 | 0.175" | .758 | .810 | .810 |
| Example 4 | 0.115" | .722 | .782 | .780 |

TABLE II-continued

| | Thickness | Average[1] Density | Density[2] Before | Density[3] After |
|---|---|---|---|---|
| Example 5 | 0.115" | .693 | .782 | .780 |

[1]average density of matrix material with microbubbles.
[2]density of same furnish of material before addition of microbubbles.
[3]density of same furnish after charging with microbubbles to form matrix material with microbubbles.

Table II clearly shows a significant reduction in the density of the matrix material with microbubbles as compared to furnishes of the same composition omitting the microbubbles. The reduction in density is thus clearly due to the presence of the microbubbles, and it constitutes an increase in bulk of the matrix material without sacrificing premolding or postmolding strength or shrink characteristics.

The increased bulk results in better calendering characteristics because it permits forming the material into a slightly thicker sheet than would otherwise be done with improved density control. The slightly thicker sheet can then be calendered to be compressed to desired finished density and thickness with a desired calendered finish. Prior art matrix materials have sometimes encountered calendering and density problems because the extra initial thickness would not be tolerated, and hence the material was sometimes too thin for proper calendering.

The matrix material of each of Examples 1–5 was cut into 10 × 10 inch sheets. These sheets were then coated with a phenolic resin coating in preparation for molding. After drying, the sheets were then brought into contact with a metallic master plate such as an engraved copper plate (the engraving being relatively shallow; on the order of from 0.05 inches to 0.15 inches). The sheets were preheated at 300° F. for 40 seconds and then were pressed against the copper master plate under pressure of approximately 100 psi in a curing oven at 300° F. for 10 minutes to emboss the matrix material with the pattern (lettering, design, etc.) on the copper master and to cure the phenolic resin in the matrix whereby a rigid printing plate matrix is formed. Each matrix was then used for the formation of rubber flexographic printing plates in the usual manner.

Upon examination the molded and cured matrix material from Examples 1–5 and the rubber printing plates formed therefrom, exhibited improved character definition and improved ripple characteristics.

While preferred embodiments have been shown and described, it will be understood that various modifications and substitutions may be made thereto without departing from the spirit and scope of the invention. Accordingly, the present invention has been described by way of illustration and not limitation.

What is claimed is:

1. A sheet of moldable matrix material for printing plates, including :

fibrous material;

thermosetting resinous material; and microbubbles;

said fibrous material, said thermosetting resinous material and said microbubbles being substantially uniformly distributed throughout said sheet of matrix material, said thermosetting resinous material in said sheet of matrix molding material being less than fully cured and said sheet of matrix material being moldable under heat and pressure to form a printing plate matrix having sharp character definition.

2. A sheet of matrix material as in claim 1 wherein:

said fibrous material is selected from the group comprising mineral fibers and organic fibers.

3. A sheet of matrix material as in claim 1 wherein:

said fibrous material is selected from the group comprising cotton fibers, wood fibers and asbestos fibers.

4. A sheet of matrix material as in claim 1 wherein:

said thermosetting resin is phenolic resin.

5. A sheet of moldable matrix material as in claim 1 wherein:

said sheet of matrix material is from approximately 0.05 inches to approximately 0.3 inches thick for shallow engraving of patterns from approximately 0.5 inches to 0.15 inches in depth.

6. A sheet of matrix material as in claim 1 wherein:

said microbubbles constitute from 5% to 25% by weight of the sheet of matrix material.

7. A sheet of matrix material as in claim 6 wherein:

said microbubbles are glass microspheres.

8. The method of forming a sheet of moldable matrix material for printing plates, including the step of:

mixing fibrous material, thermosetting resinous material and microbubbles to form a substantially uniform furnish; and forming said furnish into sheet material having said fibrous material, thermosetting resinous material and microbubbles dispersed substantially uniformly throughout said sheet material, said thermosetting resinous material being less than fully cured and said sheet of matrix material being moldable under heat and pressure to form a printing plate matrix having sharp character definition.

9. The method of claim 8 wherein:

said mixing step includes mixing fibrous material selected from mineral fibers and organic fibers.

10. The method as in claim 8 wherein:

said mixing step includes mixing fibers selected from cotton fibers, wood fibers and asbestos fibers.

11. The method as in claim 8 wherein:

said mixing step includes mixing phenolic resin.

12. The method of forming a sheet of moldable matrix material as in claim 8 wherein:

the step of forming the furnish into sheet material includes forming the furnish into a sheet of thickness ranging from approximately 0.05 inches to approximately 0.3 inches, the sheet being moldable to form shallow relief patterns ranging from 0.05 inches to 0.15 inches in depth.

13. A method according to claim 8 wherein said fibrous material includes organic fibers or mineral fibers or a mixture thereof and said microbubbles are glass, have a generally spherical shape, have diameters in the range of from about 5 microns to about 300 microns, and constitute from 5 to 25 weight percent of the matrix material.

14. The method of claim 8 wherein:

said mixing step includes mixing from 5% to 25% by weight of microbubbles with said fibrous and resinous materials.

15. The method of claim 14 wherein:

said microbubbles are glass microspheres.

16. A sheet of moldable matrix material for printing plates comprising:

a. fibrous material including organic fibers or mineral fibers or a mixture thereof;

b. thermosetting resinous material; and c. glass microbubbles having a generally spherical shape, having diameters in the range from 5 microns to 300 microns, and constituting from 5 to 25 weight percent of the matrix material;

said fibrous material, said resinous material and said glass microbubbles being substantially uniformly distributed throughout said sheet of matrix material, said thermosetting resinous material in said sheet of matrix molding material being less than fully cured and said sheet of matrix material being moldable under heat and pressure to cure said thermosetting resinous material and to form a printing plate matrix having sharp character definition.

* * * * *